US006945241B2

(12) United States Patent
Pellerite

(10) Patent No.: US 6,945,241 B2
(45) Date of Patent: Sep. 20, 2005

(54) TRIGGERLESS RELEASE AIDS AND LASER-EQUIPPED PNEUMATIC TRAINING AID FOR SAFE DRAWING OF THE BOWSTRING

(76) Inventor: Bernard M Pellerite, 1036 Arcaro Dr., Gahanna, OH (US) 43230

( * ) Notice: Subject to any disclaimer, the term of this patent is extended or adjusted under 35 U.S.C. 154(b) by 0 days.

(21) Appl. No.: 10/360,170

(22) Filed: Feb. 7, 2003

(65) Prior Publication Data

US 2003/0159682 A1 Aug. 28, 2003

Related U.S. Application Data

(60) Provisional application No. 60/355,972, filed on Feb. 12, 2002.

(51) Int. Cl.[7] ..... F41B 5/18
(52) U.S. Cl. ..... 124/35.2
(58) Field of Search ..... 124/35.2

(56) References Cited

U.S. PATENT DOCUMENTS 3,853,111 A * 12/1974 Stanislawski et al. ..... 124/35.2
3,965,884 A * 6/1976 Killian ..... 124/35.2
4,854,293 A * 8/1989 Roberts ..... 124/35.2
5,685,286 A * 11/1997 Summers ..... 124/35.2
5,694,915 A * 12/1997 Summers ..... 124/35.2
6,571,786 B2 * 6/2003 Summers et al. ..... 124/35.2
6,584,966 B1 * 7/2003 Summers et al. ..... 124/35.2
6,631,709 B2 * 10/2003 Carter et al. ..... 124/35.2
6,647,976 B2 * 11/2003 Summers et al. ..... 124/35.2

* cited by examiner

*Primary Examiner*—John A. Ricci

(57) ABSTRACT

A bowstring release includes a handle, a bowstring catch, and a link between the handle and catch. The catch includes a hook for retaining the bowstring, and a cam for holding and releasing the hook. The handle is initially rotatably mounted with respect to the link, so as the bowstring is drawn, the cam will retain the hook to hold the bowstring regardless of handle position. The handle has a spring-biased piston, and the link has one hole that can receive the piston. At full draw, the archer may rotate the handle so the piston will enter the hole in the link, locking the handle and link together. Further rotation of the handle will cause the link and attached cam to rotate out of engagement with the hook, to release the bowstring.

9 Claims, 12 Drawing Sheets

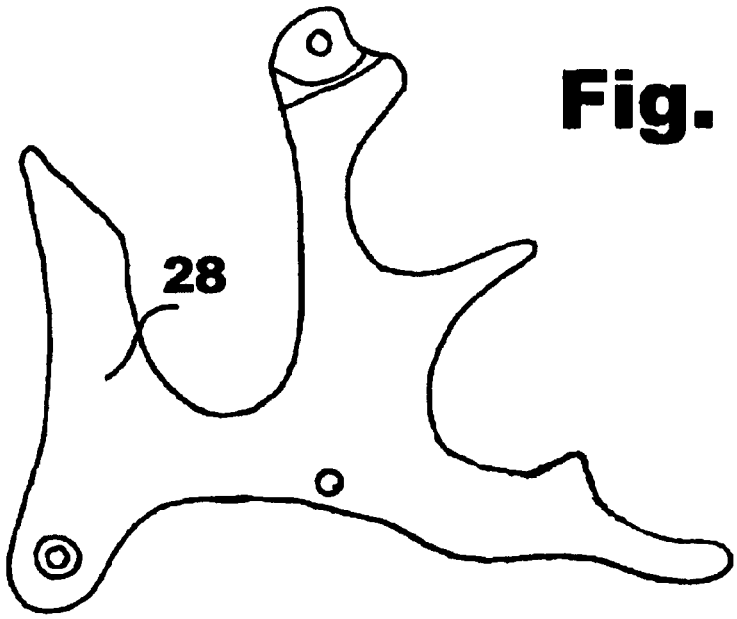
Fig. 16
4 finger
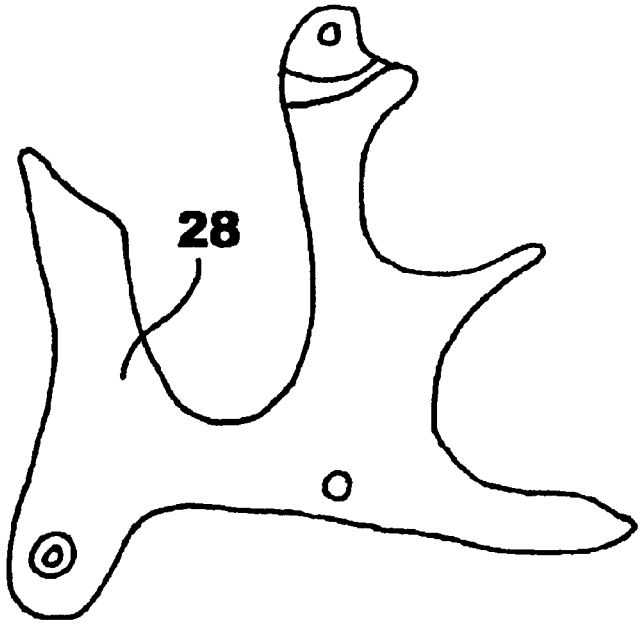
3 finger

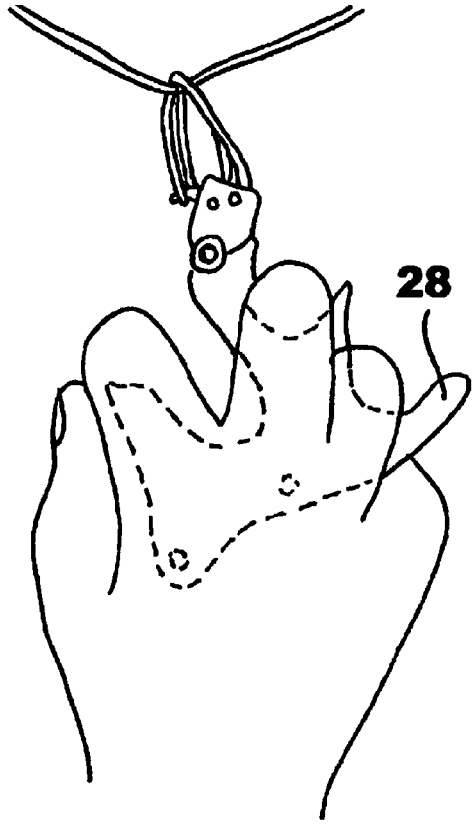
Fig. 17
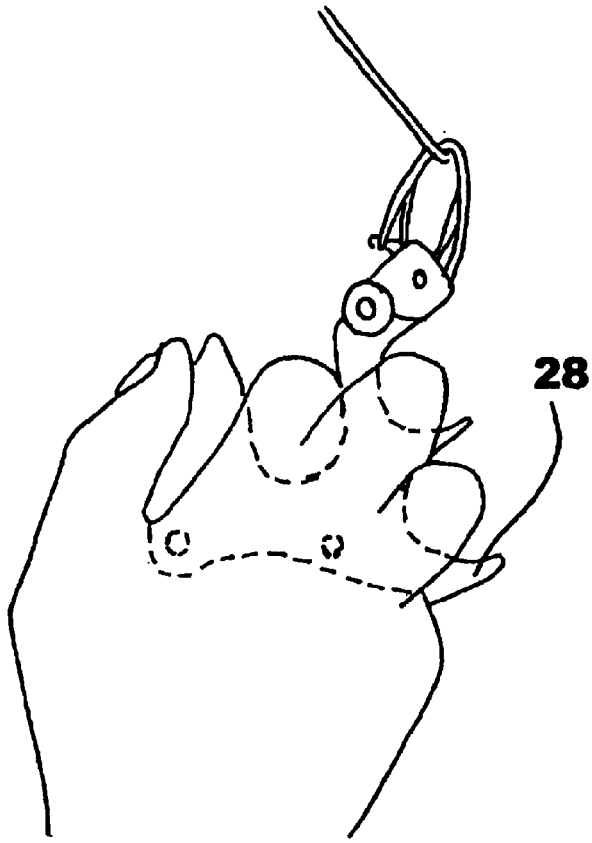

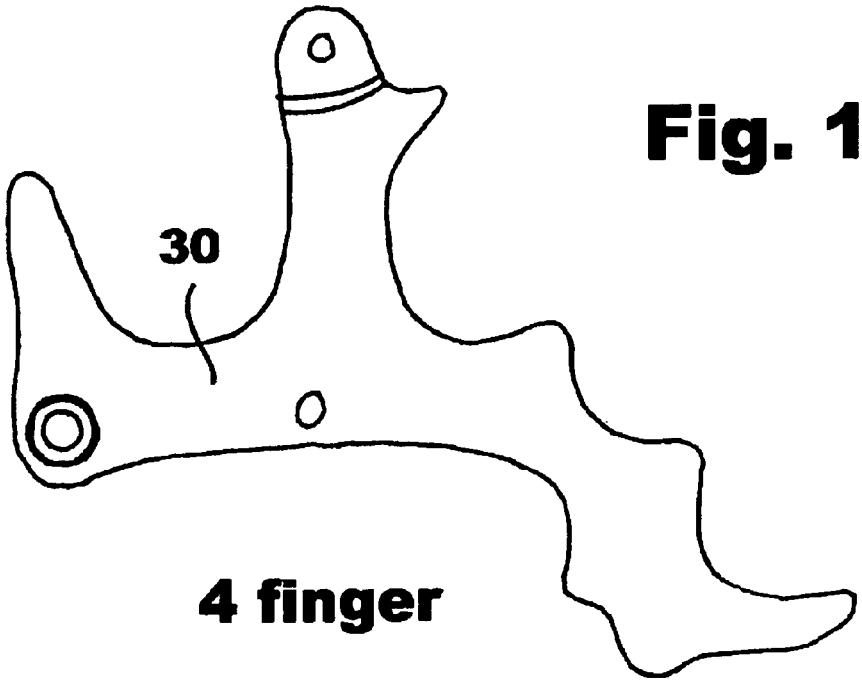
Fig. 18
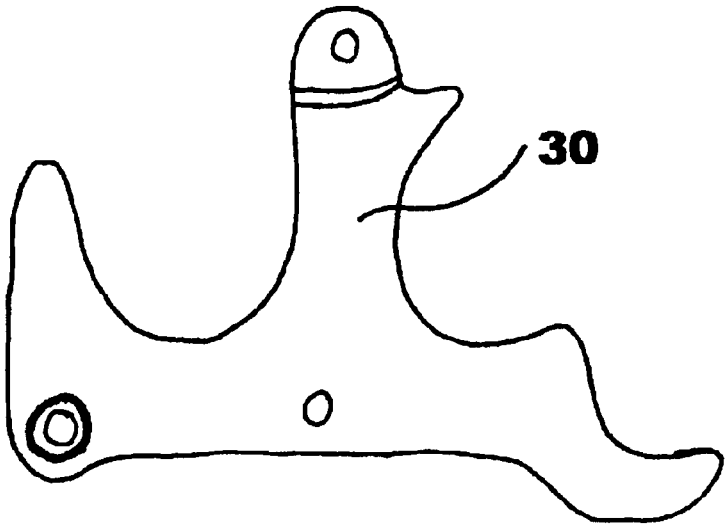
3 finger

TRIGGERLESS RELEASE AIDS AND LASER-EQUIPPED PNEUMATIC TRAINING AID FOR SAFE DRAWING OF THE BOWSTRING

This application claims priority to Provisional Application Ser. No. 60/355,972, filed Feb. 12, 2002

FIELD OF THE INVENTION

This invention is in the field of archery bowstring release devices.

DESCRIPTION OF PRIOR ART

Archery bows were originally drawn by hooking two or more fingers over the bowstring and pulling the string back from the bow. Archery technology now includes bowstring release devices, which assist the archer in gripping the bowstring securely, and releasing it smoothly. This eliminates distractions caused by the effort of gripping a bowstring directly with the fingers, and the resulting finger fatigue and soreness after multiple shots. These distractions impair an archer's concentration on aiming, and reduce the accuracy and repeatability of shots by changing the timing, consistency, and smoothness of release of the bowstring.

Representative examples of bowstring release devices are found in U.S. Pat. Nos. 5,685,286, 4,854,293, 3,965,884 and 3,853,111. These include versions for triggering by a finger/thumb and by rotating the handle.

Archers have a tendency to jerk the trigger mechanism of a release device, rather than to gradually pull through it for a smooth release. This is called "punching" the trigger. It is difficult to avoid due to the archer's intense concentration on aiming, often accompanied by an anxiety called "target panic" which increases the archer's impulsiveness. Efforts have been made to reduce anticipation of the trigger or handle movement, so the archer does not feel the release coming, and therefore does not anticipate it or flinch in reaction. These efforts include reducing the trigger movement, making triggering force independent of the drawing force, and tripping the release via the angle of the hand or arm, rather than by a simple pull of a finger. However, the latter sometimes was unsafe and the archer would inadvertently rotate the handle too much while pulling the bowstring back and prematurely release the bowstring.

These solutions are not satisfactory for all archers. The present inventions offer a new handle design, mechanism and method to trigger a bowstring release indirectly, which is natural and effective for most archer, prevents anticipation or flinching and is safe enough as not to release the bowstring accidentally.

SUMMARY OF THE INVENTION

The main objectives of the present inventions are to safely draw back the bowstring and to reduce tactile feedback from a bowstring release mechanism or trigger, thus hiding the exact moment of release from the archer to eliminate anticipation, jerking of the trigger mechanism, or flinching at the instant of release. There are also three optional methods contained herein.

The first release aid contains a handle with a middle section that attaches it to a catch mechanism. The catch consists of a hook, rotating on an axle to capture the bowstring (or a string loop that captures the bowstring). The lower end of the hook rides against an adjustable half moon shaped cam, set on an axle in the middle, or linking section.

This axle, that is attached to the half moon cam has a dial at one end to facilitate ease in fine adjustment of the cam, which effects how quickly the release goes off. The archer can safely pull back the bowstring without the release being active, because the middle section freely rotates independent of the handle and can be linked by the archer after the bow is drawn fully and the archer is ready to release. This is done by rotating the handle forward laterally until a spring loaded pin in the neck of the handle lines up with, and springs up into, an orifice in the bottom of the link, at which time the handle is joined with the catch. Then the archer can reverse the rotation, until the lower end of the hook overrides the edge and disengages the half moon shaped cam. The hook then rotates out of the way on the axle and looses the captured string.

An alternate release aid described within has a safe draw handle design, without the linking section, but with the same type of catch as mentioned above. It also has the dial on the end of the axle that adjusts the cam. The handle contains two index finger holds; one position for safely drawing, the other for releasing. The first position is higher than the other and is adjacent to the second. The bow is drawn with the index finger in the higher position, which puts more pressure on that side of the handle, naturally rotating it counterclockwise to the safe draw position. Once the bow is fully drawn, the archer can then drop the index finger off the high hold, down to the low hold position, which allows the handle to rotate clockwise (for right-handed archers), until the catch disengages and releases the bowstring. A version for using three or four fingers is described.

Another alternate release aid has a handle without the linking section but with the same type of catch. It also has the dial on the end of the axle that adjusts the cam. As with the above method, lateral clockwise rotation of the handle causes the release. While drawing back the string, one must maintain a counterclockwise lateral force to the handle to keep the device from releasing the bowstring (as with the above example). This device has a cut out on the bottom side of the handle underneath the little finger hold. This cutout is where the knuckle of the little finger is placed and upward pressure is applied, helping to hold the handle in the safer, counterclockwise position, until the bow is fully drawn. Then the knuckle is removed from the bottom of the handle and the little finger is placed on top of the handle, enabling the archer to rotate the handle clockwise, thus releasing the bowstring. A three finger version eliminating the little finger is also described.

BRIEF DESCRIPTION OF THE DRAWINGS

FIG. 16 shows the handle style as shown in FIG. 8, both a 4-finger and 3-finger version.

FIG. 17 shows how the handle of FIG. 16 is held and operated.

FIG. 18 shows the handle style as shown in FIG. 9, both a 4-finger and 3-finger version.

REFERENCE NUMERALS

Figure 1:
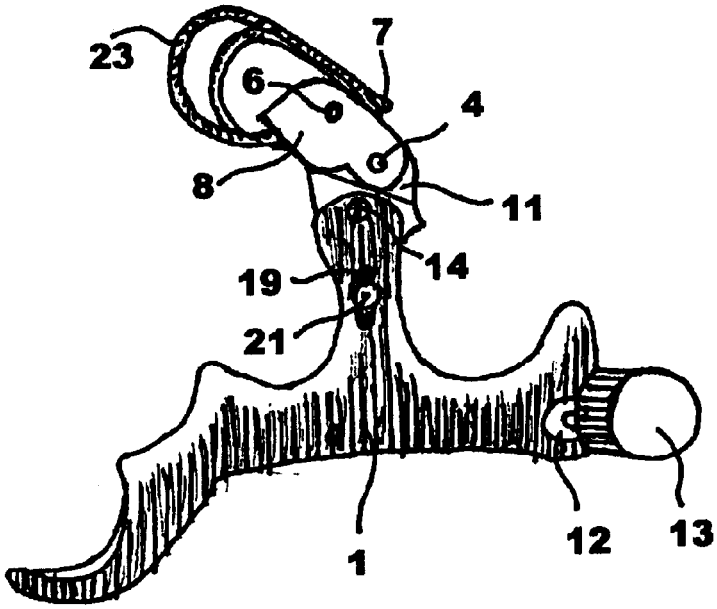
FIG. 1 shows an archery bowstring release device
Figure 2:
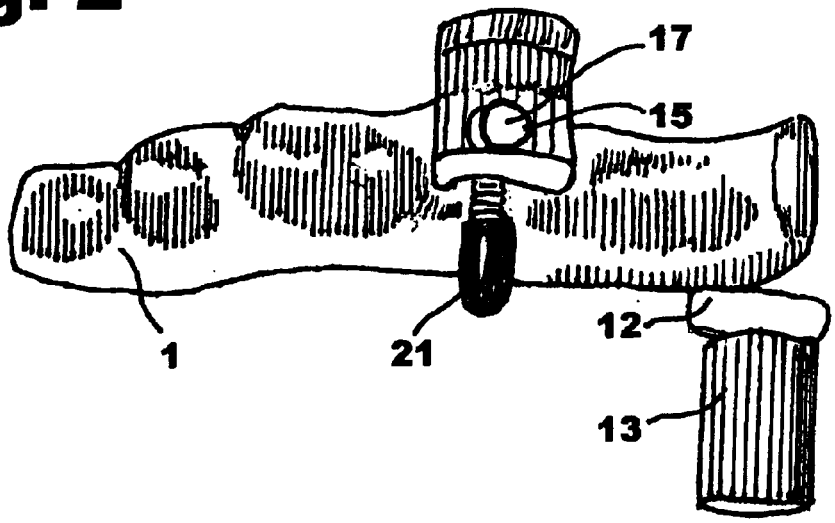
FIG. 2 shows a top view of the archery bowstring release in FIG. 1 with the catch and link removed.
Figure 3:
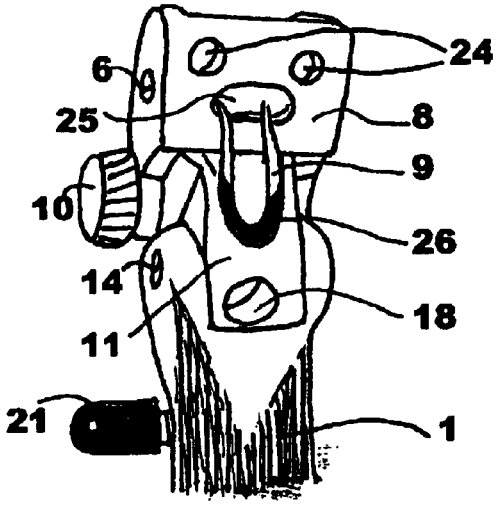
FIG. 3 shows close up of the back side of the catch and link of the archery bowstring release in FIG. 1.
Figure 4:
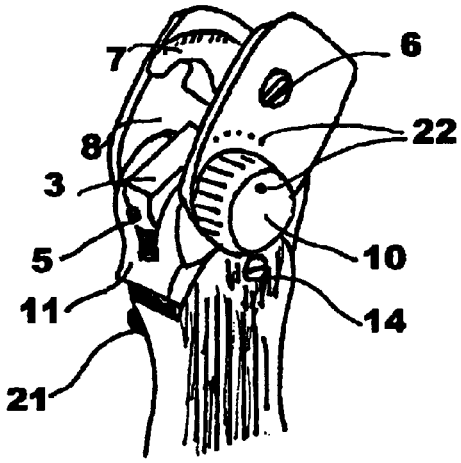
FIG. 4 shows close up of the side of the catch and link of the archery bowstring release in FIG. 1.
Figure 5:
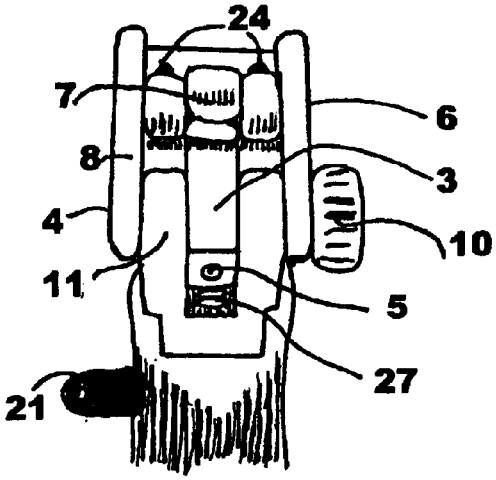
FIG. 5 shows dose up of the front of the catch and link of the archery bowstring release in FIG. 1.
Figure 6:
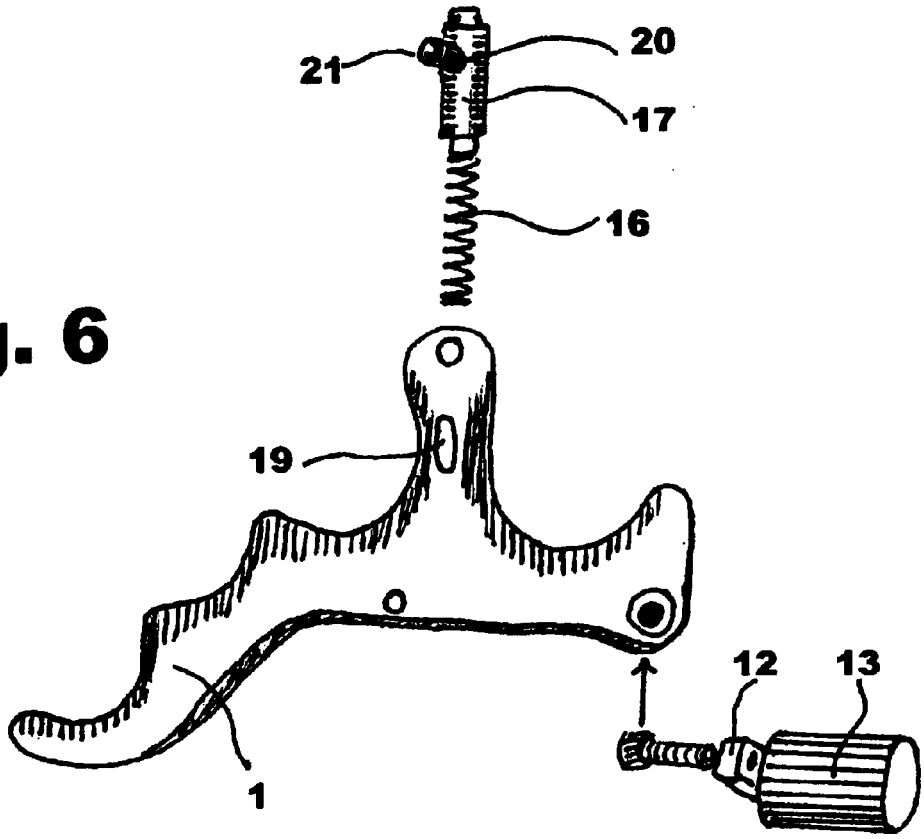
FIG. 6 shows the archery bowstring release in FIG. 2 with all parts visible.
Figure 7:
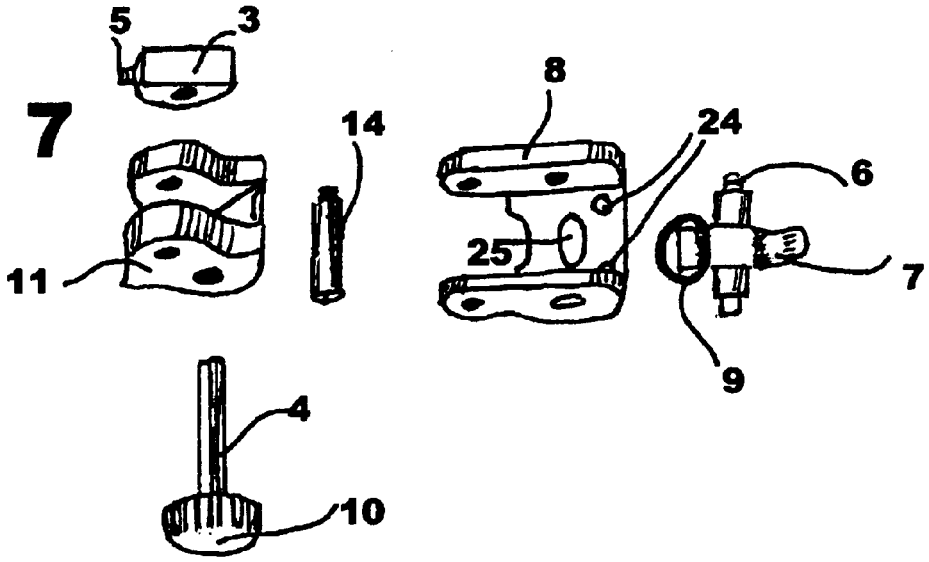
FIG. 7 shows all individual parts of the link and the catch

1. Handle
2. Catch
3. Cam
4. Lower hood-cam-link axle
5. Setscrew
6. Upper hook-hood axle
7. Hook
8. Hood
9. Elastic band
10. Dial Indicator
11. Link
12. Spacer
13. Thumb Barrel
14. Link-handle axle
15. Piston channel
16. Spring
17. Piston
18. Link Hole
19. Slot
20. Hole in Piston
21. Un-cocking Lever
22. Marks on Dial Indicator and Hood
23. Release Rope (Optional)
24. Holes for Release Rope
25. Slot in Hood for Elastic Band
26. Elastic Band Groove
27. Link Set Screw
28. Handle
29. Set Screw
30. Handle

DESCRIPTION OF THE PREFERRED EMBODIMENTS

The release aid of the first embodiment consists of three sections: the handle 1; the catch 2; and the link 11 between the handle and the catch. The catch is comprised of eight parts: cam 3, lower cam axle 4, set screw 5, upper hook axle 6, hook 7, hood 8, elastic band 9, and dial indicator 10. The handle can accommodate 3, 4, or 5 fingers in natural positions. The handle may include a spacer 12 that is affixed to one end. An optional cylinder-shaped thumb barrel 13 for gripping can be attached to the spacer 12, or thumb barrel 13 may be affixed directly to handle 1 without the spacer 12. Even without the spacer 12 or thumb barrel 13, the archer can still grip with the thumb by placing the thumb on the end of the handle.

As the archer begins to draw the bowstring back, the handle 1 is not rotatably locked to the catch 2, so the catch cannot release the string, and is rendered safe until full draw position is reached. The handle is rotatably connected to the link 11 by means of an axle 14. The handle also has a channel or hole 15 which accommodates a piston 17, biased toward the link by means of a spring 16. The link has a hole 18. As the archer rotates the handle relative to the link, the holes 15 and 18 will become aligned, and the piston will be pushed into hole 18 so the handle and link will become rotationally locked.

The handle also has a slot 19 which exposes part of channel 15. Piston 17 has a threaded hole 20, and an un-cocking lever 21 is threadedly attached into this hole 20, through slot 19. This allows the archer to release piston 17 from hole 18 so the handle and link can be relatively rotated again.

With the handle and link in the locked condition, the archer may release the bowstring by rotating the handle 1 until the hook 7 disconnects from the half moon shaped cam 3, thereby releasing the captured bowstring. The link 11 has an upper through hole, and catch 2 is connected to the link 11 by means of cam axle 4 which extends through the upper through hole. The cam 3 is secured to the cam axle 4 by means of a set screw 5, so when axle 4 is rotated, cam 3 rotates also. The cam 3 and cam axle 4 can be rotatably adjusted to change the bowstring release point. The end of the axle 4 may include a mark or groove, or a dial indicator 10 with marks may be mounted on the end of axle 4; complementary marks 22 may be provided on hood 8. A set screw 27 holds the assembly of the cam 3, axle 4, and indicator 10 in the selected position.

The hook 7 is rotatably mounted to hood 8 by means of upper hook axle 6; hook 7 includes a curved top end for capturing a bowstring or bowstring loop, or looped end of a rope 23 mounted to the hood by means of holes 24. the hook has a bottom tapered end which rides against cam 3. As the handle is rotated clockwise (for a right-handed archer), the tapered end of the hook 7 eventually slides off the edge of cam 3, which causes hook 7 to release its hold on the string, and loose the arrow.

The cam 3 may have a small notch or groove in one edge so as to make an audible click as the tapered edge of the hook slides near the edge of the cam and drops into the groove. This warns the archer that the device is extremely close to releasing the bowstring. The cam may be reversed so the notch is not in proximity to the tapered end of the hook; this allows for total surprise release. The catch also includes a feature to reset the hook with respect to the cam. The back of the hood 8 has a slot or hole 25 to accommodate an elastic band 9 and attaches to the bottom of the hook 7 and to the back side of the link 11, through a horseshoe shaped groove 26.

Figure 8:
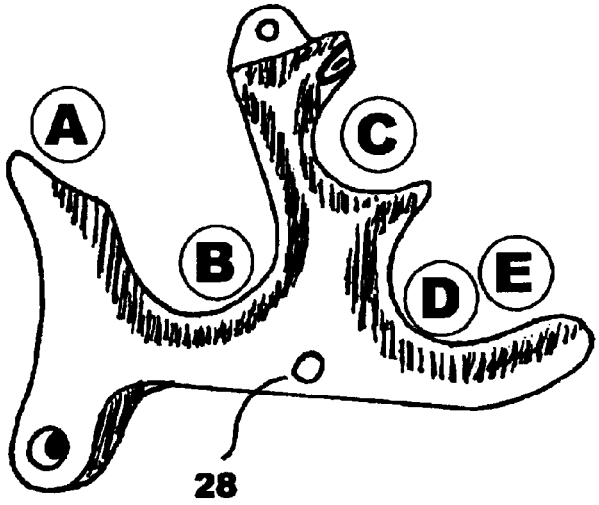
FIG. 8 shows a first alternative handle style.

An alternative handle 28 is shown in FIG. 8. The elastic band is attached to this handle differently from handle 1. In handle 1, the elastic band is attached from the hook 7 to the link 11. But in handle 28, the elastic band is attached from the hook to a set screw 29 in the back of the handle. Handle 28 can be pulled with a straight wrist and 3, 4, or 5 fingers evenly until, at full draw, the index finger is moved from high position A to lower finger hold position B; the handle angle is now changed to a ready-to-fire position. The middle finger is placed on finger hold position C; the ring finger id placed at D, and position E may be used for the little finger. Spacer 12 and thumb barrel 13 may also be secured to handle 28 as a thumb hold. Operation is comparable to handle 1.

Figure 9:
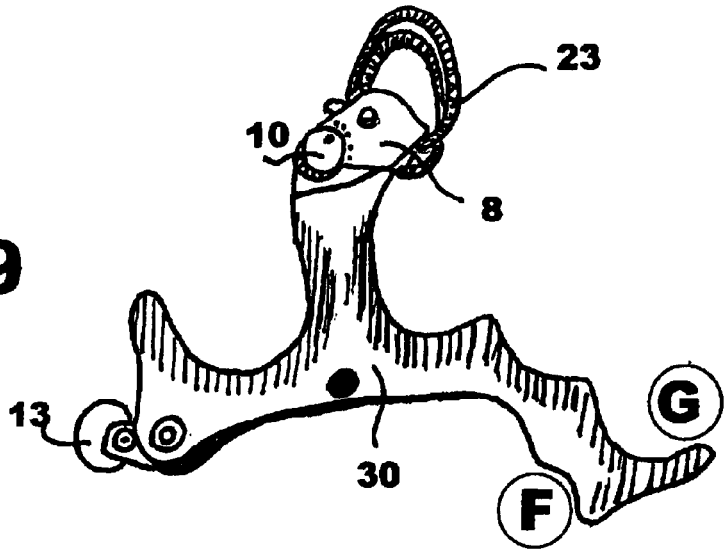
FIG. 9 shows a second alternative handle style, complete.
Figure 10:
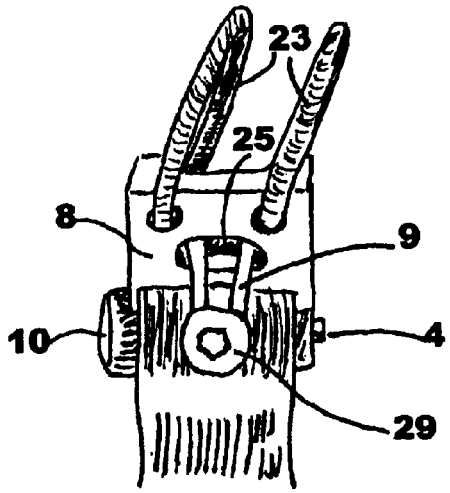
FIG. 10 shows close up of the back side of the catch of the archery bowstring release in FIG. 9.
Figure 11:
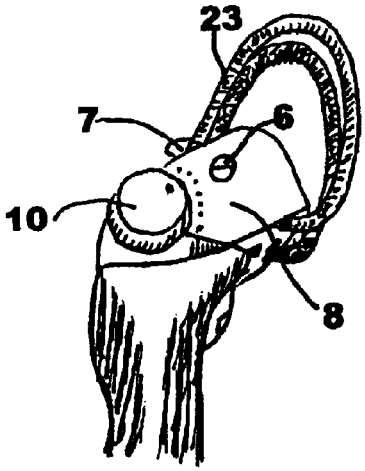
FIG. 11 shows close up of the side of the catch of the archery bowstring release in FIG. 9.
Figure 12:
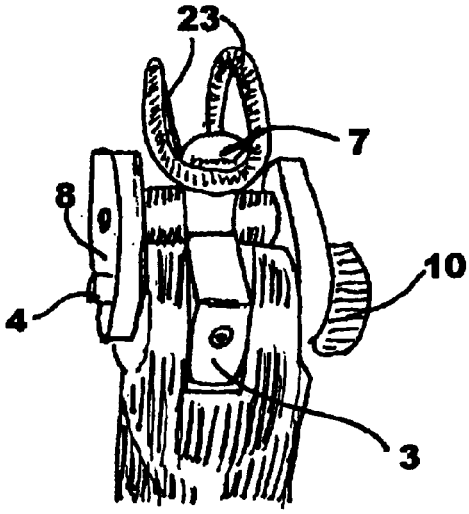
FIG. 12 shows close up of the front of the catch of the archery bowstring release in FIG. 9.
Figure 13:
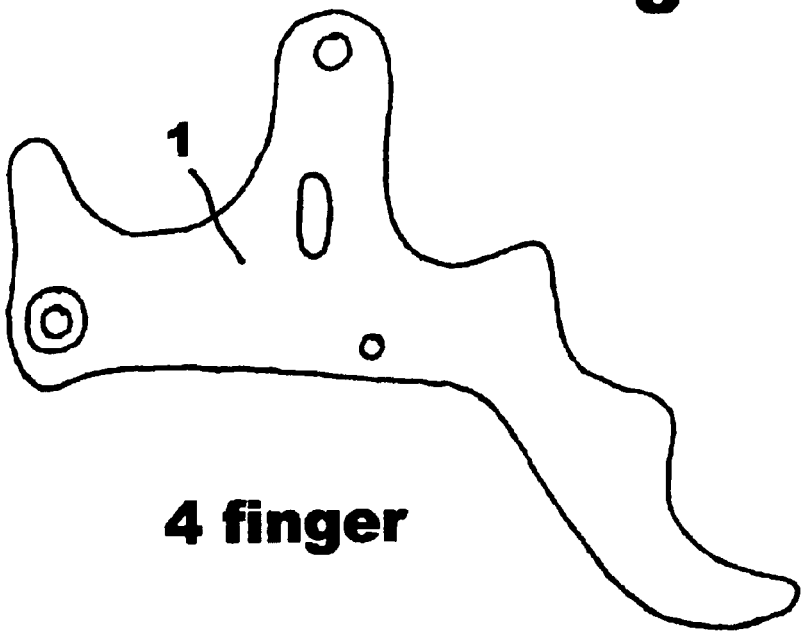
FIG. 13 shows the handle style as shown in FIG. 1, both a 4-finger and 3-finger version.
Figure 13:
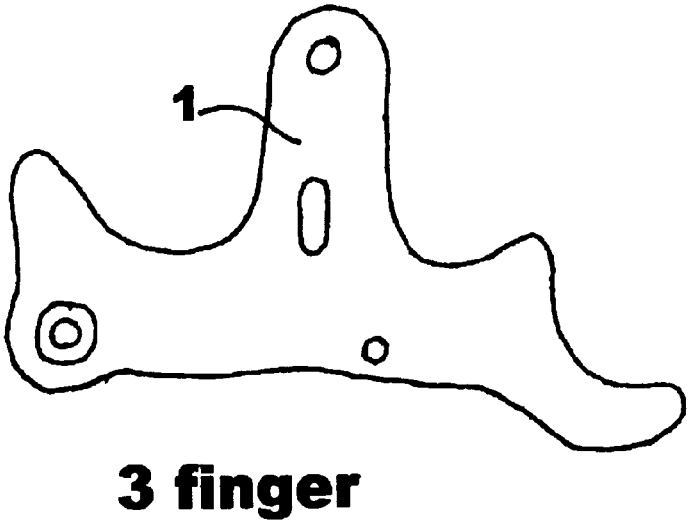
Figure 14:
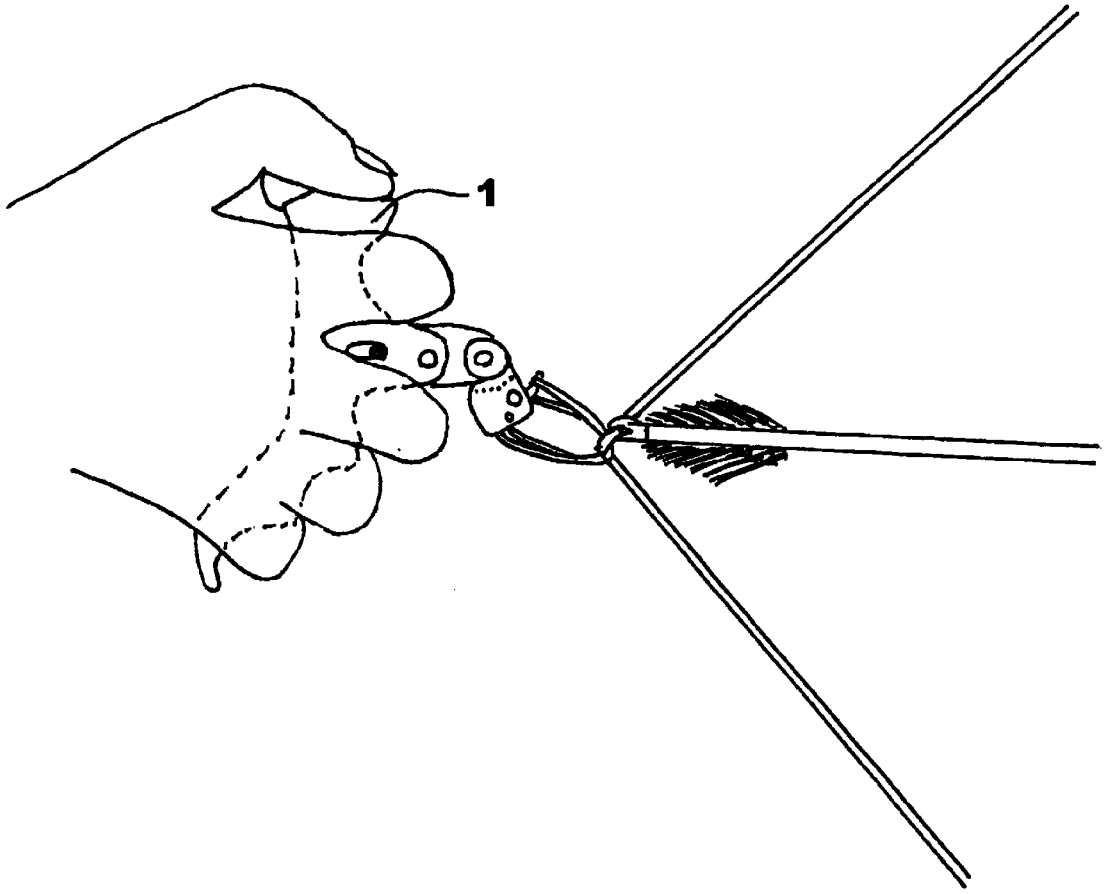
FIG. 14 shows how the handle of FIG. 13 is held.
Figure 15:
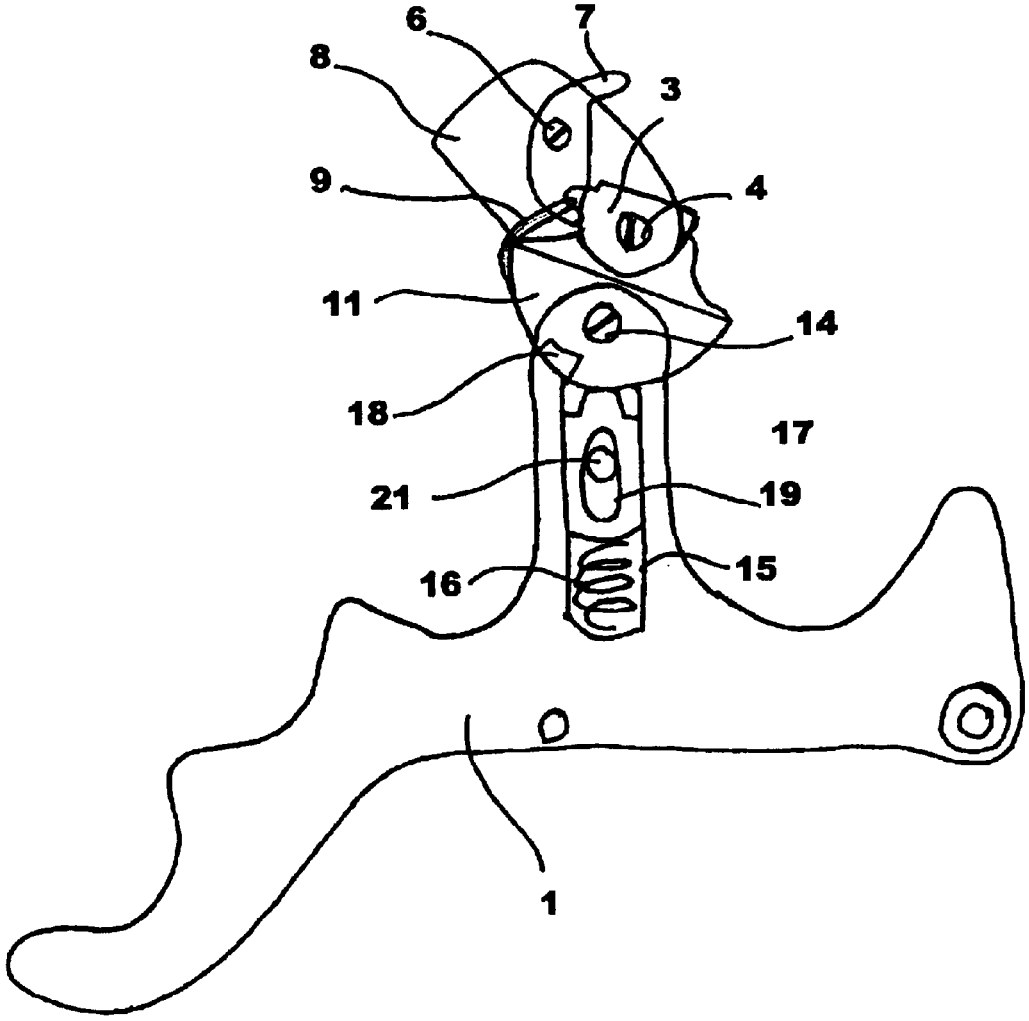
FIG. 15 shows the internal mechanism of the handle of FIG. 13.
Figure 19:
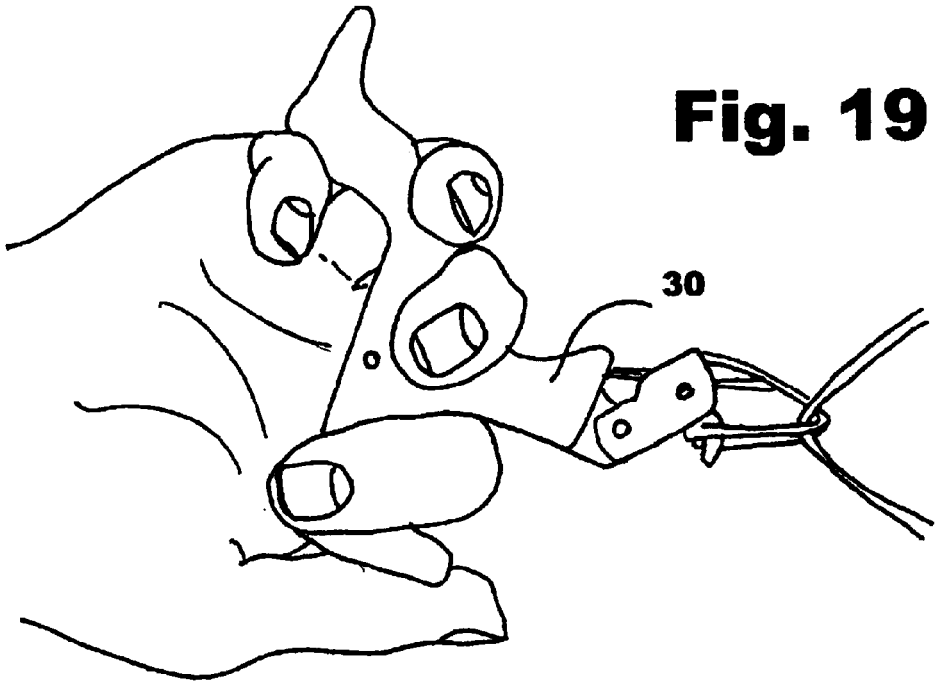
FIG. 19 shows how the handle of FIG. 18 is held.
Figure 20:
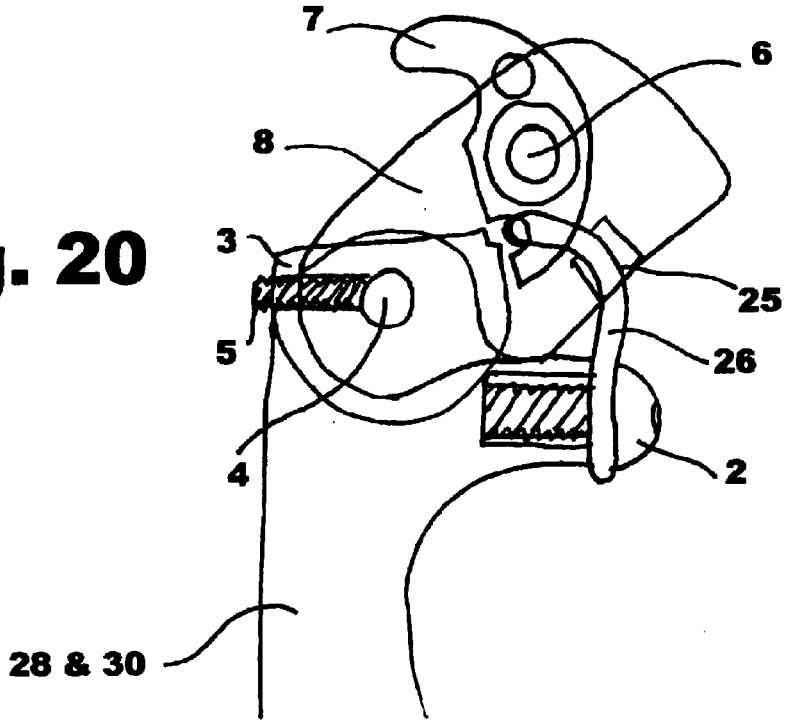
FIG. 20 shows the internal mechanism of the catch for the handles of FIGS. 8 and 9.

Another alternative handle 30 is shown in FIG. 9. The elastic band is attached to this handle differently from handle 1. In handle 1, the elastic band is attached from the hook 7 to the link 11. But in handle 30, the elastic band is attached from the hook to a set screw 29 in the back of the handle. Handle 30 can be pulled safely with a straight wrist and 3, 4, or 5 fingers evenly pulling as long as the little pinkie finger is placed in position F until the handle and link become anchored, after which the pinkie finger can be placed in position G to help set off the release.

I claim:

1. A safe-draw archery bowstring release, comprising:

a handle for pulling back the bowstring, the handle having a gripping portion and a post extending forward from the gripping portion;

a piston slidably disposed in the post and biased forward toward an open end of the post by means of a spring, the piston having a forward locking portion;

a link pivotally mounted to a forward end of the post by means of an axle, the link having a single hole extending thereinto, the hole being in registration with the piston in one and only one pivotal position of the link with respect to the handle, allowing the locking portion of the piston to extend into the hole and locking the link from further pivoting with respect to the handle;

the link having a half-circle shaped cam fixably mounted thereto;

a hood mounted to the link, the hood pivotally supporting a hook by means of an axle;

the hook having a curved end adapted to engage a bowstring or looped rope, and a tapered end adapted to engage a curved edge of the cam;

the parts arranged such that during draw of a bowstring, the piston is out of registration with the link hole, and the tapered end of the hook is in engagement with the curved surface of the cam, which positions the hook so that the curved end will engage the bowstring, or rope loop; and in order to release the bowstring, an archer will rotate the handle in a first direction so that the piston will engage the link hole, and then rotate the handle in a second direction so that the cam attached to the link will rotate out of engagement with the hook, allowing the hook to pivot and release the bowstring, or rope loop.

2. The archery bowstring release of claim 1, in which the cam is pivotally mounted to the link by means of an axle, and is held stationary by means of a set screw extending through the body of the cam and engaging the axle.

3. The archery bowstring release of claim 2, in which the pivotal position of the cam is adjustable by means of a knob affixed to an end of the cam axle, thus adjusting the release position of the hook relative to the handle.

4. The archery bowstring release of claim 1, further including an elastic band extending between the hook and the link, for biasing the hook so that the tapered end will be in position to engage the curved surface of the cam again when the piston is disengaged from the link hole, and the bowstring is drawn again.

5. A safe-draw archery bowstring release, comprising:

a handle for pulling back the bowstring, the handle having a gripping portion;

a half-circle shaped cam fixably mounted to a forward portion of the handle;

a hood mounted to the forward portion of the handle, the hood pivotally supporting a hook by means of an axle;

the hook having a curved end adapted to engage a bowstring or looped rope, and a tapered end adapted to engage a curved edge of the cam;

the parts arranged such that during draw of a bowstring, rotation of the handle in a first direction will cause the hook to remain in engagement with the cam, maintaining engagement of the cam with the bowstring or rope loop, and rotation of the handle in a second direction will cause the cam to rotate out of engagement with the hook, allowing the hook to pivot and release the bowstring, or rope loop;

wherein the gripping portion of the handle includes a front surface facing toward the cam, and a rear surface; a thumb rest configured to engage the thumb of an archer, an index finger rest configured to engage the index finger of an archer, a middle finger rest configured to engage the middle finger of an archer, a first ring finger rest on the front surface, configured to engage the rear of the ring finger of an archer, and a second ring finger rest on the rear surface, configured to engage the front or knuckle of the ring finger of an archer;

wherein placement of the front or knuckle of the archer's ring finger on the second ring finger rest will tend to rotate the handle in the first direction, helping to maintain the bowstring or rope loop in engagement with the hook, and placement of the rear of the archer's ring finger on the first ring finger rest will make it easier to rotate the handle in the second direction, to release the bowstring or rope loop.

6. The safe-draw archery bowstring release of claim 5, further including a first little-finger rest on the front surface, configured to engage the rear of the little-finger of an archer, and a second little-finger rest on the rear surface, configured to engage the front or knuckle of the little-finger of an archer;

wherein placement of the front or knuckle of the archer's little-finger on the second little-finger rest will tend to rotate the handle in the first direction, helping to maintain the bowstring or rope loop in engagement with the hook, and placement of the rear of the archer's little-finger on the first little-finger rest will make it easier to rotate the handle in the second direction, to release the bowstring or rope loop.

7. A safe-draw archery bowstring release, comprising:

a handle for pulling back the bowstring, the handle having a gripping portion;

a half-circle shaped cam fixably mounted to a forward portion of the handle;

a hood mounted to the forward portion of the handle, the hood pivotally supporting a hook by means of an axle;

the hook having a curved end adapted to engage a bowstring or looped rope, and a tapered end adapted to engage a curved edge of the cam;

the parts arranged such that during draw of a bowstring, rotation of the handle in a first direction will cause the hook to remain in engagement with the cam, maintaining engagement of the cam with the bowstring or rope loop, and rotation of the handle in a second direction will cause the cam to rotate out of engagement with the hook, allowing the hook to pivot and release the bowstring, or rope loop;

wherein the gripping portion of the handle includes a middle finger rest configured to engage a middle finger of an archer, a ring finger rest configured to engage a ring finger of an archer, a higher index finger rest configured to engage an index finger of an archer, and a lower index finger rest configured to engage an index finger of an archer;

wherein the higher index finger rest extends a substantial distance higher, toward the cam, than the lower index finger rest, and placement of the archer's finger on this higher index finger rest will tend to rotate the handle in the first direction, helping to maintain the bowstring or rope loop in engagement with the hook, and placement of the archer's finger on the lower index finger rest will make it easier to rotate the handle in the second direction, to release the bowstring or rope loop.

8. The safe-draw archery bowstring release of claim 7, further including a thumb rest configured to engage the thumb of an archer.

9. The safe-draw archery bowstring release of claim 7, further including a little finger rest configured to engage the little finger of an archer.

* * * * *